United States Patent [19]

Johnson et al.

[11] 4,065,102

[45] Dec. 27, 1977

[54] METHOD OF REMOVING PRINTING PRESS ROLLERS AND REMOVAL MECHANISM FOR USE THEREIN

[76] Inventors: Laurence E. Johnson, 2063 S. Birch, Santa Ana, Calif. 92707; Duane S. Reynolds, 1180 Bryan, No. D, Tustin, Calif. 92680

[21] Appl. No.: 712,912

[22] Filed: Aug. 9, 1976

[51] Int. Cl.[2] ..... B66D 1/00

[52] U.S. Cl. ..... 254/186 HC; 101/425

[58] Field of Search ..... 254/186 HC, 186 R, 142, 254/139, 190 R; 100/176; 101/212, 152, 153, 216, 425; 270/18; 214/130 R, DIG. 4, DIG. 3

[56] References Cited

U.S. PATENT DOCUMENTS

| | | | |
|---|---|---|---|
| 2,194,125 | 3/1940 | Rinehart | 214/DIG. 3 |
| 2,525,346 | 10/1950 | Gilbert | 214/DIG. 4 |
| 2,910,032 | 10/1959 | Kunouse | 254/186 HC |
| 3,536,298 | 10/1970 | Deslierres | 254/190 R |
| 3,789,757 | 2/1974 | Motter et al. | 101/216 |
| 3,919,733 | 11/1975 | Susnjara | 101/425 |
| 3,944,095 | 3/1976 | Brown | 214/DIG. 4 |
| 3,964,621 | 6/1976 | Youngkamp | 214/DIG. 4 |

FOREIGN PATENT DOCUMENTS

| | | | |
|---|---|---|---|
| 649,937 | 2/1951 | United Kingdom | 214/DIG. 4 |

*Primary Examiner*—Trygve M. Blix
*Assistant Examiner*—Kenneth Noland
*Attorney, Agent, or Firm*—Harvey C. Nienow

[57] ABSTRACT

The method of removing printing press rollers or cylinders, and a removal mechanism for use therein in extracting relatively heavy printing press rollers from very restricted and confined locations.

The method comprises affixing to the frame of the press a pair of removal mechanisms, one at each end of the press. Each such mechanism comprises a mounting bracket including clamping means, a winch and an extension having an opening through which the winch line extends. The extension rests against the topmost rollers and the line is extended into the center of the press to be wrapped about the respective end of the roller to be removed. Simultaneous operation of such winches causes the roller to be lifted from its bearings or journal, thereafter to be lowered by means of the winches for manual removal.

4 Claims, 5 Drawing Figures

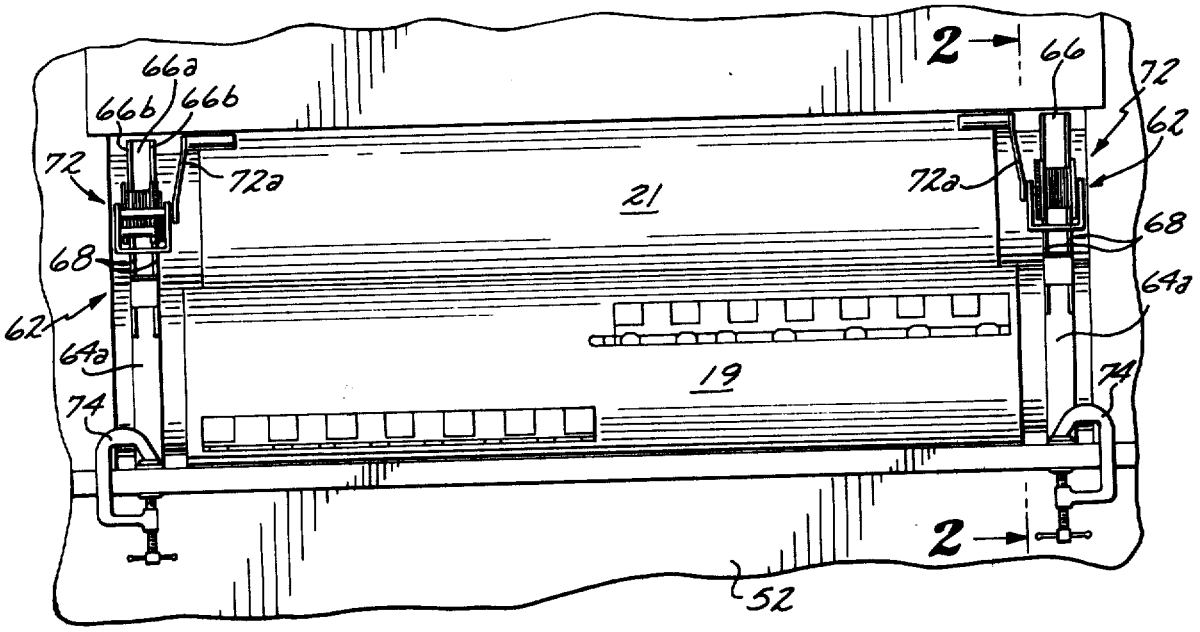
FIG. 1
FIG. 3
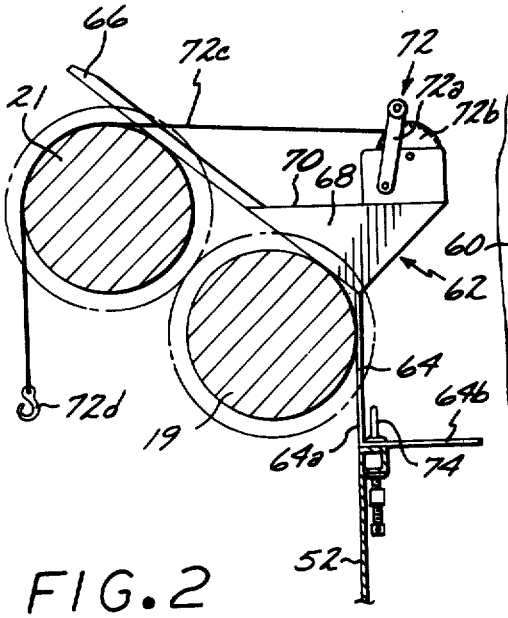
FIG. 2
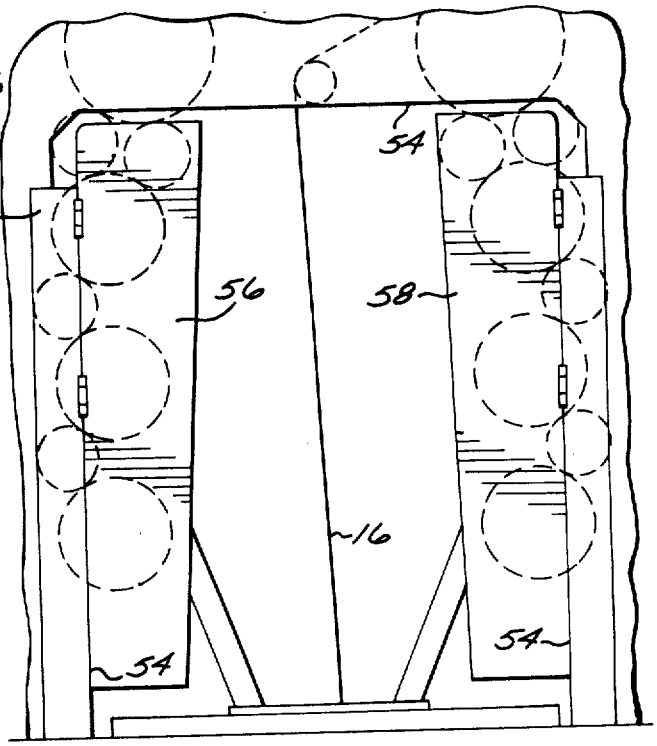

METHOD OF REMOVING PRINTING PRESS ROLLERS AND REMOVAL MECHANISM FOR USE THEREIN

The present invention relates generally to a method for removing printing press rollers or cylinders and to a removal mechanism for use therein, but more particularly to such method and mechanism for quickly and easily removing rollers from a relatively large press.

Printing presses today are very large and are capable of printing thousands of copies of newspapers every hour. Such presses are complicated in construction and operation, and comprise many different rollers or cylinders for performing various different functions. For instance, some of the rollers are for the purpose of evenly distributing ink while other rollers are primarily for use in transporting the newsprint from a storage location to the printing rollers. It is not uncommon for such rollers or cylinders to be formed of steel, approximately 6½ inches in diameter and approximately 80 inches in length. The weight of such a roller is approximately 200 pounds. As such, it is frequently very difficult for such rollers to be manually placed in or removed from the bearings or journals wherein they are rotationally held in place in the printing press.

This is particularly true on certain types of presses which are constructed such that the various rollers are disposed in an inverted U-shape, and access to the interior of the press is therefore very limited. That is, it is not uncommon for such a press to have an access opening on the order of 24 inches wide and 35 inches high, through which the various rollers must be taken during removal and replacement.

In view of the foregoing, it is an object of the present invention to teach a method of removing printing press rollers which involves utilizing a removal mechanism which is mounted on the outside or exterior of the press but which provides lifting means into the interior thereof.

A further object of the present invention is to teach a method as characterized above wherein a pair of removal mechanisms are mounted on the frame of the press but wherein a pair of lines can be inserted into the interior of the press to thereby raise and lower certain rollers, as desired.

An even further object of the present invention is to teach a method as characterized above whereby rollers can be removed from their mounting means and lowered to a position such that they can be manually removed from the interior of the press.

Another even further object of the present invention is to teach a method as characterized above wherein manually operated winches are employed in the method for quickly and easily removing the printing press rollers.

Another object of the present invention is to provide a removal mechanism for quickly and easily removing printing press rollers from a printing press.

Another object of the present invention is to provide a removal mechanism as characterized above which employs a winch mounted exteriorly of the press and which has a line which extends into the interior of the press to retain a roller so as to lift the same and lower it as desired.

An even further object of the present invention is to provide a removal mechanism as characterized above which includes an extension which rests against certain rollers of the press to provide support such that the winch can develop forces strong enough to raise and lower rollers to be removed.

An even further object of the present invention is to provide a removal mechanism as characterized above which is simple and inexpensive to manufacture, and which is rugged and dependable in operation.

The novel features which we consider characteristic of our invention are set forth with particularity in the appended claims. The invention itself, however, both as to its organization and mode of operation, together with additional objects and advantages thereof, will best be understood from the following description of specific embodiments when read in connection with the accompanying drawings, in which:

FIG. 1 is a fragmentary side elevational view of a portion of a printing press;

FIG. 2 is a fragmentary sectional view taken substantially along line 2—2 of FIG. 1;

FIG. 3 is a fragmentary end elevational view of a typical press;

Like reference characters indicate corresponding parts throughout the several views of the drawings.

Figure 4:
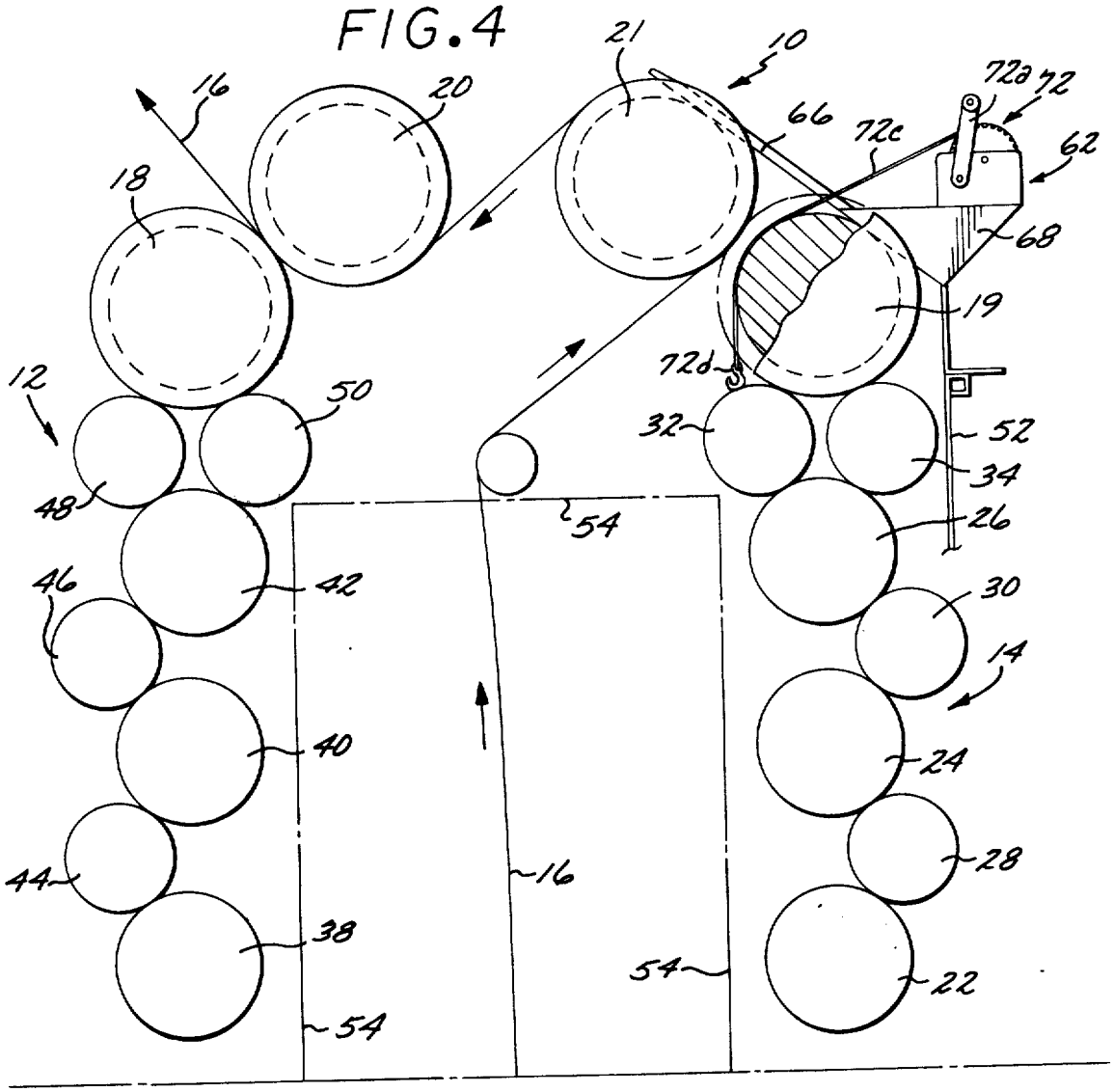
FIG. 4 is an end elevational view of a press showing the arrangement of press rollers or cylinders.

Referring to FIG. 4 of the drawings, there is shown therein, in more or less schematic presentation, a printing press 10 having a left bank of cylinders or rollers 12 and a right bank of cylinders or rollers 14. The paper or newsprint 16 is shown as it progresses upward from a storage location (not shown) to the printing rollers of the press.

A pair of plate rollers or cylinders 18 and 19 are provided with the printing type such that as the paper 16 progresses or passes through the press, both sides of the newsprint are provided with the desired printing. Blanket rollers 20 and 21 are provided as shown to provide a firm surface against which the plate rollers work to perform such printing function.

The press shown in FIG. 4 is generally symmetrical, each of the left and right banks 12 and 14 having the same kinds of rollers or cylinders. The right bank 14 has three oscillator rollers 22, 24 and 26 and two distributor rollers 28 and 30. The printing ink enters the right bank 14 at oscillator 22 and is then transferred successively to distributor 28, oscillator 24, distributor 30 and oscillator 26. The ink is then transferred to a pair of form rollers 32 and 34 for subsequent transfer to the printing type on plate cylinder 19.

Referring to the left bank 12, it is seen that it has similar rollers, namely oscillators 38, 40 and 42 and distributors 44 and 46, as well as form rollers 48 and 50 which carry the ink to the plate cylinder 18.

Although FIG. 4 shows the arrangement of rollers in more or less schematic fashion, the press 10 further comprises a frame 52 about the exterior of the press as well as end supports for carrying the bearings or journals wherein the opposite ends of the rollers or cylinders are rotatably mounted.

The broken line 54 in FIG. 4 depicts the limited access or passageway to the interior of the press. Usually, such access opening is on the order of 2 feet wide and 3 feet high, and must be used for various repair, maintenance and reconstruction functions necessary in maintaining a printing press in good working order.

Referring to FIG. 3 of the drawings, the general outline of the rollers is shown in broken lines and the end of the press 10 is shown as including a pair of doors 56 and 58 which are hingedly connected to frame members 60. The basic frame structure for the press 10 is generally inverted U-shape to provide the necessary configuration for firmly retaining the rollers in the desired relation.

As shown most particularly in FIGS. 1 and 2 of the drawings, the subject removal mechanism comprises a frame 62 formed of sheet steel and having a support 64 which is generally L-shaped so as to have a vertical leg 64*a* and a horizontal leg 64*b*.

Firmly secured to the support 64 is an extension 66 which, as shown most clearly in FIG. 1 of the drawings, is generally U-shaped, being formed of a channel member the intermediate portion 66*a* of which is approximately 2 inches wide and the upstanding side portions 66*b* of which are approximately ¾ inch high. Triangularly shaped gussets or braces 68 are provided on either side of the removal mechanism 62 and a mounting platform 70 is formed between the braces 68.

A manually operated winch 72 is secured to the mounting means 70, such winch having an operating crank 72*a* as well as the necessary gears 72*b* to provide a mechanical advantage in raising and lowering a winch line 72*c* which may be formed of any appropriate material such as steel, or synthetic materials such as nylon, and the like. A hook 72*d* is provided on the end of line 72*c* as shown in the drawings.

To firmly secure the removal mechanism 62 to the press 10, a C-clamp 74 is provided, such clamp being used to firmly grip the horizontal leg 64*b* of the support 64 to the frame 52 of the exterior of the press 10.

Figure 5:
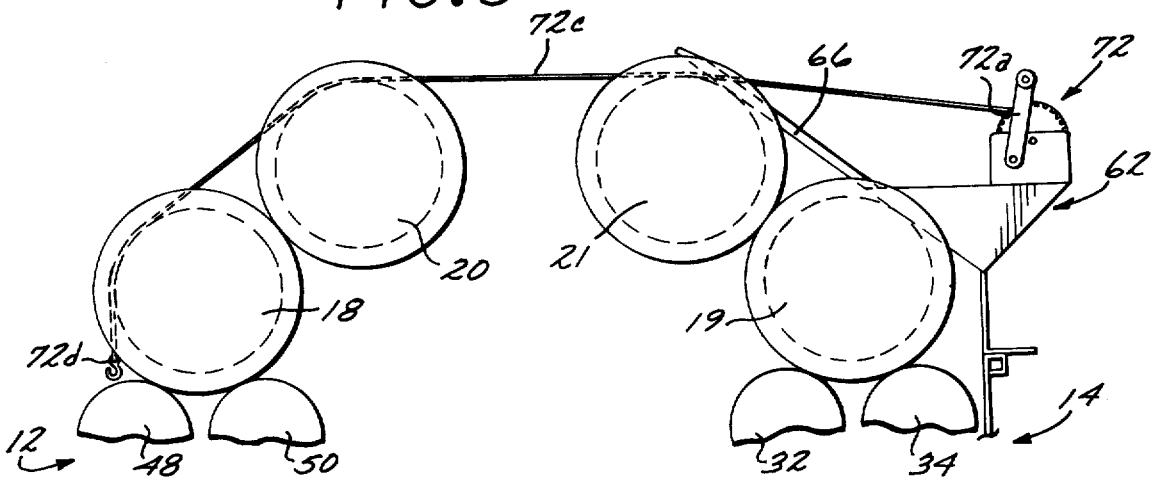
FIG. 5 is a fragmentary elevational view of a portion of the press of FIG. 4.

The removal mechanisms 62 are used in pairs and, as shown most particularly in FIG. 1 of the drawings, are mounted at opposite ends of the press. The extension 66 of each such mechanism 62 is caused to rest on the appropriate pair of plate and blanket cylinders as shown in FIGS. 2, 4 and 5 of the drawings. That is, the subject removal mechanisms 62 can be used on either side of the press 10, and when placed in operation, should firmly rest upon the cylinders or rollers near the top of the press.

As shown in FIG. 2 of the drawings, the line 72*c* of the mechanism 62 may be caused to extend over the blanket cylinder 36 so as to enable the hook 72*d* to drop down into the interior of the press 10 as shown. For this purpose, extension 66 is formed with a through opening in the intermediate portion 66*a* to accommodate passage of such hook 72*d* and line 72*c*.

As shown in FIG. 4 of the drawings, the line 72*c* may extend over the plate cylinder 19 so as to cause hook 72*d* to drop down into the press at a point adjacent to the right bank of rollers 14.

In like manner, if desired, the line 72*c* of the mechanism 62 may extend over the rollers or cylinders 36, 20 and 18 to a postion outside of the left bank of rollers or cylinders 12.

The winch lines of the two removal mechanisms 62 are then lowered to the particular roller to be removed. Such removal is necessary to recondition such rollers to maintain the press in good operating condition. In order to minimize shut-down time, frequently such rollers are removed and a replacement part substituted therefor.

By looping the line 72*c* about the end of the cylinder or roller, the hook 72*d* can be hooked about the line to provide a firm connection. Then, by substantially simultaneously operating the several winches 72, the cylinder is lifted or raised from its journal mountings, pulled away from the bank of rollers or cylinders and thereafter lowered to the floor or platform of the press for quick and easy manual removal from the press. By reversing the operation, namely by manually placing the substitute roller within the access opening of the press, and attaching the winch lines thereto, the winches can be used to raise the substitute roller to its operating position.

It is thus seen that the present invention provides a method for removing printing press rollers or cylinders from a printing press in a quick and efficient manner. The invention also provides a mechanism for use in such method to accomplish the desired removal of a printing press roller or cylinder.

Although we have shown and described certain specific embodiments of our invention, we are well aware that many modifications thereof are possible. The invention is not to be restricted except insofar as is necessitated by the prior art and by the appended claims.

We claim:

1. A handling mechanism for handling a printing press roller comprising in combination,
   a frame,
   a support for said frame formed with a generally vertically disposed leg and a generally horizontally disposed leg for ready attachment and removability to a structural member of a printing press,
   said frame comprising an extension fixed to said vertical leg of said support and forming an obtuse angle therewith to engage a pair of press rollers when said support is attached to said structural member,
   mounting means on said extension and positioned between said extension and said support and comprising a generally horizontal mounting pad,
   and a winch secured to said mounting pad and having a line which is directed generally horizontally toward said extension and thereby being coupled to a printing press roller for handling thereof and also provide the effect that a pulling force on said line exerts a force on said pair of press rollers.

2. A handling mechanism for a printing press roller according to claim 1,
   wherein said extension is formed with an opening through which the line from said winch extends to the roller to be removed.

3. A handling mechanism for a printing press roller according to claim 2,
   wherein said extension is formed with a U-shape having an intermediate portion and a pair of spaced side portions, said opening being formed in said intermediate portion.

4. A handling mechanism for a printing press roller according to claim 3,
   wherein said support means comprises clamping means to secure said frame to said structural member of said printing press.

* * * * *